US007195320B2

(12) United States Patent
Brisebois

(10) Patent No.: US 7,195,320 B2
(45) Date of Patent: Mar. 27, 2007

(54) THERMAL ROCK FRAGMENTATION APPLICATION IN NARROW VEIN EXTRACTION

(75) Inventor: Donald Brisebois, Ile Perrot (CA)

(73) Assignee: Rocmec International Inc., Chicoutimi (CA)

( * ) Notice: Subject to any disclaimer, the term of this patent is extended or adjusted under 35 U.S.C. 154(b) by 198 days.

(21) Appl. No.: 10/863,496

(22) Filed: Jun. 9, 2004

(65) Prior Publication Data

US 2005/0012381 A1 Jan. 20, 2005

Related U.S. Application Data

(63) Continuation-in-part of application No. 10/303,868, filed on Nov. 26, 2002, now Pat. No. 6,913,320.

(51) Int. Cl.
*E21C 37/16* (2006.01)
*E21B 7/14* (2006.01)

(52) U.S. Cl. ..... 299/14; 175/11; 175/16

(58) Field of Classification Search ..... 299/14; 175/11, 16

See application file for complete search history.

(56) References Cited

U.S. PATENT DOCUMENTS 3,245,721 A * 4/1966 Margiloff ..... 299/14
3,539,221 A * 11/1970 Gladstone et al. ..... 299/14
3,608,967 A 9/1971 Vasselin et al.
3,826,536 A 7/1974 Boyd et al.
4,020,317 A * 4/1977 Colgate ..... 219/121.35
4,304,308 A 12/1981 Munding et al.
4,928,765 A 5/1990 Nielson
5,007,683 A * 4/1991 Granskog ..... 299/10
5,107,936 A 4/1992 Foppe
5,771,984 A 6/1998 Potter et al.
6,056,057 A 5/2000 Vinegar et al.
6,375,271 B1 4/2002 Young, III
6,913,320 B2 * 7/2005 Brisebois ..... 299/14
2005/0242654 A1 * 11/2005 Fecteau et al. ..... 299/14

OTHER PUBLICATIONS

"Radisson Mining Resources Inc.: Positive Results From the Work on O'Brien"—News Release published on Internet on Oct. 15, 2001.

"Axes of Research—Explosive-Free Rock Breaking Technologies"—slide show presentation on Oct. 3, 2001.

* cited by examiner

*Primary Examiner*—David Bagnell
*Assistant Examiner*—Shane Bomar
(74) *Attorney, Agent, or Firm*—Ogilvy Renault LLP

(57) ABSTRACT

A free-blast method for extracting ore from an ore vein deposit wherein the vein is extracted by causing the ore comprised between the rock walls bordering the vein to spall into fragments. The ore fragments are recuperated as by aspiration and subsequently processed to retrieve the precious mineral.

4 Claims, 4 Drawing Sheets

THERMAL ROCK FRAGMENTATION APPLICATION IN NARROW VEIN EXTRACTION

RELATED APPLICATIONS

This Application is a Continuation-In-Part of U.S. patent application Ser. No. 10/303,868, filed Nov. 26, 2002, now U.S. Pat. No. 6,913,320 issued on Jul. 5, 2005.

BACKGROUND OF THE INVENTION

1. Field of the Invention

The present invention relates to ore extraction and, more particularly, to thermal fragmentation mining for extracting ore from narrow-veins.

2. Description of the Prior Art

For many years, mine operators have worked on various ways to mechanize mining. They have succeeded in many cases where the ore volume was sufficient to justify the high capital costs of equipment and the required infrastructures. Narrow-vein deposits, for their part, presented a greater challenge in terms of mechanization. Selective mining methods, such as shrinkage, were replaced by using a mechanized long-hole mining method. Despite all the efforts put into place, success stories remain rare. The difficulty in controlling wall stability following blast vibrations often resulted in high dilution, preventing narrow-veins extraction from being economically viable. Indeed, veins of small cross-section have in the past been uneconomical to mine since with the current mining methods a small vein necessitates the removal of a large quantity of waste rock on either sides of the vein. A large quantity of ore must then be processed to retrieve the small quantity of desired minerals.

Therefore, a great number of known narrow veins of mineralization are not presently mined since mining of such minerals is not economically viable due to the limitations of the present mining methods.

SUMMARY OF THE INVENTION

It is therefore an aim of the present invention to provide a new ore extracting process for allowing narrow veins of mineralization to be mined profitably.

It is a further aim of the present invention to provide a new and efficient mining approach for extracting ore from narrow-veins.

It is a still further aim of the present invention to optimize ore recuperation.

It is a further aim of the present invention to provide a new narrow-vein ore extraction process by which dilution from the walls of the vein is minimal.

Therefore, in accordance with the present invention, there is provided a process for extracting ore from a vein having opposed sidewalls, comprising the steps of a) drilling a hole in the vein, b) enlarging an entry end portion of the hole to dimensions suitable for accommodating a burner, c) lowering the burner into the entry end portion of the hole d) igniting the burner and gradually advancing the burner further into the hole to cause the ore to spall into fragments and e) recuperating the fragmented ore.

In accordance with a further general aspect of the present invention, there is provided a method for extracting ore from an ore vein deposit, comprising the steps of a) establishing the location of the rock walls bordering the ore vein deposit, b) exposing a face through which the ore vein deposit extends, c) causing the ore comprised between the rock walls to spall into fragments, and d) retrieving the fragments.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
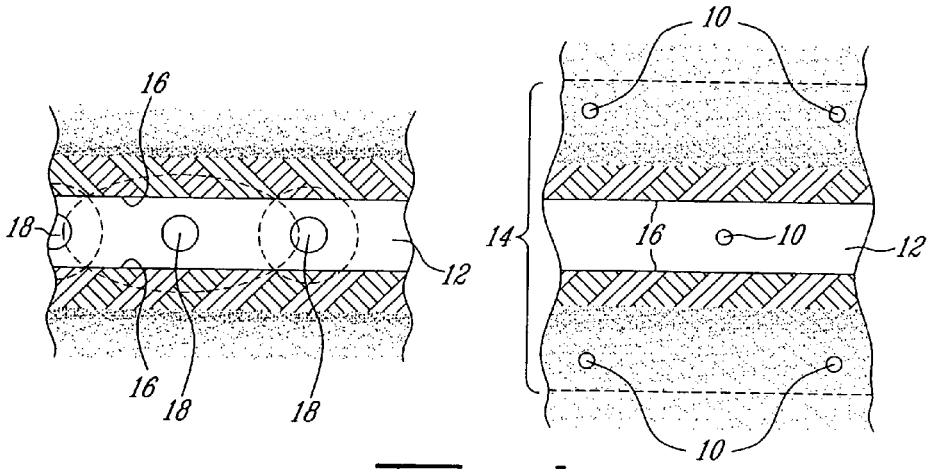
FIG. 1 is a schematic comparison between a long-hole mining method and a thermal fragmentation mining concept in accordance with a preferred embodiment of the present invention.

It is a problem in the field of mining to economically extract high grade materials, such as gold, platinum, copper or other precious materials, from a narrow vein of mineralization. A narrow vein of mineralization is normally not commercially mined because the return in volume of useable mineral for the amount of ore removed and the amount of labor required to remove the ore render it uneconomical to retrieve the desired minerals in a narrow vein application. As will be seen hereinafter, the present invention provides a solution to that particular problem by significantly minimizing the dilution of the precious mineral into the surrounding waste rock during the extraction operation.

Unlike conventional mining methods which require that a great amount of commercially worthless rock (barren) be removed on either side of the vein due to the utilization of explosive charges, the present free-blast mining method provides for the removal of the true value only, i.e. the extraction of the mineral deposit from the surrounding environment. This may be readily appreciated from FIG. 1 which shows a schematic comparison between the dilution associated with a conventional mining method and the present thermal fragmentation mining method. More particularly, according to the conventional long-hole mining method, blastholes 10 are drilled in the vein 12 and on either side thereof. Each blasthole 10 is filled with an explosive charge, such as dynamite, and the region in the vicinity of the blastholes 10 is fragmented by the explosive power of the charge. This results in the formation of a large trench 14 which extends laterally outwardly of the vein sidewalls 16 along all the length of vein 12. For instance, in the case of a vein having a 30 cm (12 inches) width, a trench of 140 cm (55 inches) in width will have to be blasted. This implies a dilution of about 55 cm (22 inches) on each side of the vein 12 throughout the length thereof. That is to say that the amount of waste or commercially worthless material that has to be mined is significantly greater than the amount of material comprised between the vein sidewalls 16. The ratio is about 6 tonnes of commercially worthless matter for 1 tonne of desired mineral.

In contrast, according to the present invention, pilot holes 18 (not blastholes) are defined directly in the vein 12 and subsequently enlarged or reamed by thermal fragmentation to the vein sidewalls 16, thereby avoiding dilution of the ore body contained in the vein in the commercially worthless matter located outwardly of the vein sidewalls 16. The trench can be kept as narrow as possible. This permits to extract 1 tonne of the desired mineral for 2 tonnes of gangue.

Figure 2:
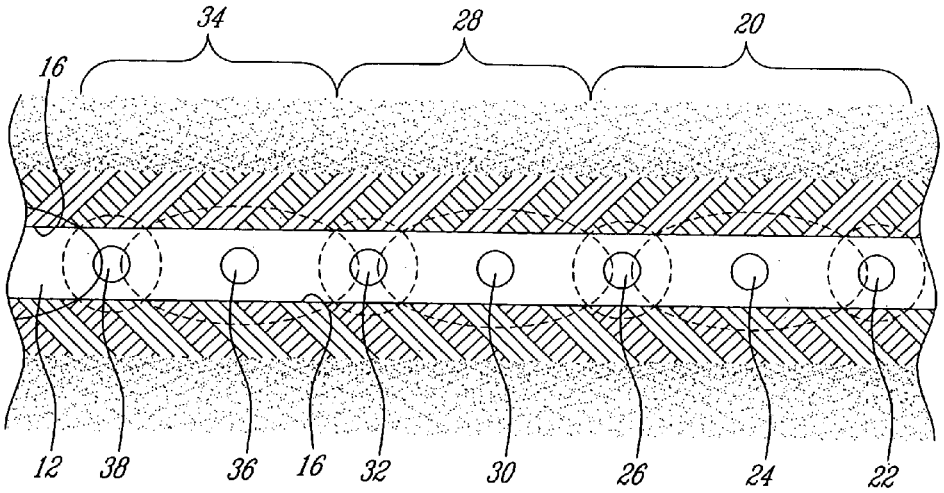
FIG. 2 is a schematic top plan view of an ore vein illustrating how the ore can be recuperated by thermal rock fragmentation.

According to a first mode of extraction of the present invention, a first series 20 of three pilot holes 22, 24 and 26 are drilled directly into the vein 12 at predetermined longitudinal intervals, as shown in FIG. 2. The intervals are determined by the width of the vein 12. For a vein having a 12 inches (30 cm) width, the pilot holes are preferably of about 6 inches (15 cm) in diameter and spaced by a distance of about 21 inches (53 cm). Each pilot hole is between 40 feet (12 m) to 60 feet (18 m) deep and substantially center relative to a central axis of the vein 12. The broken material produced is recuperated and subsequently processed to separate the mineralized material from the barren.

The next step consists in the verification of the pilot holes 22, 24 and 26. In order to make sure that the pilot holes 22, 24 and 26 are in the vein 12, a conventional in-the-hole device (not shown) is used to locate the vein 12. Once the ore is located in the pilot holes 22, 24 and 26, thermal fragmentation is started to enlarge each pilot hole to the sidewalls 16 of the vein 12. In practice, it is understood that the pilot holes 22, 24 and 26 might in some instances be thermally reamed to a location which is located slightly outwardly of the sidewalls 16 of the vein 12, as shown in dotted lines in FIG. 2. Each pilot hole is enlarged by lowering a strong burner (not shown), powered by diesel fuel and air, into the bottom of the hole and by igniting it. The burner could also be provided in the form of a plasma torch, especially in underground mining operations. Other types of burners and torches could be used as well. In fact, various free-blast rock spalling techniques could be used to extract the ore from the vein.

The heat generated by the burner raises the temperature in the hole up to 1800° C. This creates thermal stresses that spall the rock. In simple terms, spalling is considered to be a form of decrepitation caused by an unequal expansion of rock crystals which overcomes molecule cohesion. The broken or fragmented material produced during this process ranges in size from fine grain to 4 cm (1.6 inch). The burner is gradually raised from the bottom of the hole to ream the hole on all the length thereof.

The first three pilot holes 22, 24, and 26 are preferably individually enlarged along all the length thereof from bottom to top in a predetermined sequence starting with the first hole 22, the third hole 26 and the second hole 24. The broken material produced during the thermal fragmentation operation of the first and third holes 22 and 26 is preferably left in the holes to act as a thermal barrier for preventing heat from escaping from the second hole 24 when the pillars of material separating the second hole 24 from the first hole 22 and the second hole 24 from the third hole 26 start to become fragmented, thereby allowing heat to pass from the second hole 24 to the first and the third holes 22 and 26. By leaving the fragmented material in the holes until the thermal fragmentation is fully completed in the adjacent hole, significant saving can be made in term of thermal energy consumption. As shown in dotted lines in FIG. 2, the second hole 24 is enlarged to a greater extent than the first and third holes 22 and 26 so as to completely fragment the pillar between the first and second holes 22 and 24 and the pillar between the second and third holes 24 and 26.

Thereafter, a second series 28 of pilot holes, comprising two longitudinally spaced-apart holes 30 and 32, are drilled directly in the vein 12 at the downstream end of the first series 20. The second pilot hole 32 of the second series 28 is first enlarged by thermal fragmentation followed by the first pilot hole 30. As for the first series 20, the fragmented material produced during the thermal fragmentation performed in each hole is preferably left in the hole and the first pilot 30 is enlarged to a greater extent than adjacent holes 26 and 32. As a general rule, the holes which are enlarged to a large size are always comprised between two pairs of pilot holes which have already been enlarged. As represented by reference numeral 34 further pairs of longitudinally spaced-apart pilot holes 36 and 38 are subsequently drilled and enlarged until the end of the vein 12 is reached.

Once the vein 12 has been fragmented on all the length thereof or along a sufficient portion thereof, the fragmented material is recuperated as by aspiration.

For deep veins extending more than 60 feet (18 m) deep into the surrounding strata, the waste rock surrounding the veins can be blasted after the ore contained in the first 60 feet (18 m) deep or so of the veins has been recovered as per the way described hereinbefore. In this way, the ore body of the vein can be fragmented and retrieved on another 60 feet (18 m) deep by repeating the above described steps from the new excavated bench level. It is understood that the 60 feet (18 m) deep is dictated by the limits of the drilling equipment and is only given for illustrative purposes.

Figure 3:
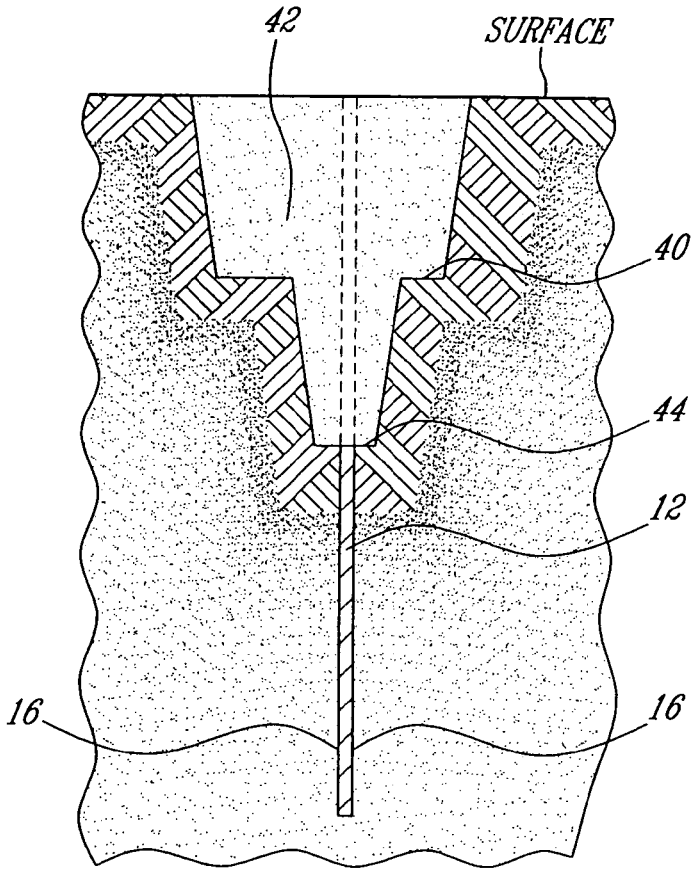
FIG. 3 is a schematic elevation view showing a surface excavation design that can be used when the narrow vein is extracted by thermal fragmentation.

As shown in FIG. 3, for a three-bench extraction of narrow veins, the stripping ratio is much less when using the thermal fragmentation mining concept. Because of the small size of the mobile equipment (the burner), the final pit shape can be kept as narrow as possible. This provides significant mining cost reduction. It is also advantageous in that it contributes to minimize dilution by avoiding stripping of waste.

The second bench level 40 is formed by blasting the waste rock 42 surrounding the vein 12 after the ore body comprised in the first 60 feet (18 m) deep of the vein 12 has been retrieved from the first or surface level. After, the second bench level 40 has been excavated, the mining equipment, including the drill and the burner, is moved onto the platform of the second bench level 40 and pilot holes are drilled and enlarged by thermal fragmentation as per the way described hereinbefore. The fragmented material is retrieved as by aspiration and the site is further excavated to form a third bench level 44 to permit retrieval of the remaining deepest portion of the vein 12.

The above described thermal fragmentation mining method can be adapted to either surface or underground mining.

According to another aspect of the present invention, it has been found that smaller diameter pilot holes could be drilled in the vein while still using thermal fragmentation technique to subsequently enlarge the holes. This is advantageous in that it greatly simplifies the drilling process and, thus, contributes to significantly lower the production costs.

Figure 6:
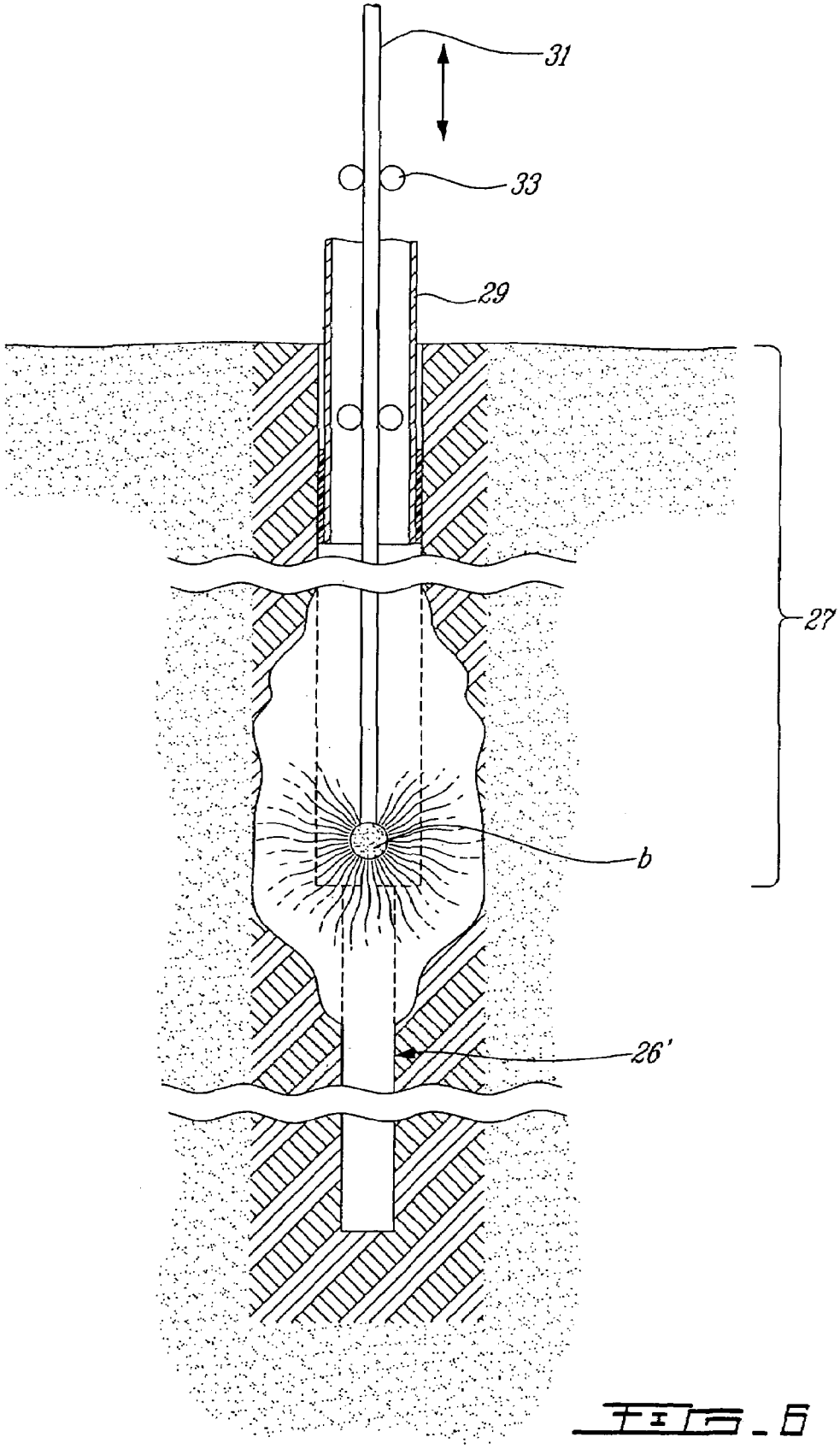
FIG. 6 is schematic cross-sectional elevation view of a small diameter pilot hole having a mechanically enlarged entry end portion for receiving a burner, the enlarged entry end portion is sealed and the burner is progressively lowered into the hole to ream the same all along the length thereof from the entry end to the bottom end of the hole, in accordance with a further general aspect of the present invention.

As shown in FIG. 6, a pilot hole 26' of about 3 inches in diameter is first drilled directly in the vein to a depth of about 15 to 20 meters. Then, the entry end portion 27 of the small diameter hole is subsequently enlarged to about 6 inches along approximately 4 feet to provide enough room for receiving the burner b. The small diameter hole 26' is preferably drilled with a conventional long-hole drill.

The burner b is lowered into the enlarged entry end portion 27 of the small diameter hole 26' through a tube 29 connected to a source of vacuum and sealed at its periphery to the entry end portion 27 of the small diameter hole 26'. The burner b is mounted at the end of a flexible rubber tube 31 drivingly engaged between rubber rollers 33 driven by a conventional hydraulic motor. The movement of the burner b in the hole is thus controlled through the operation of the rubber rollers 33. The burner b is ignited and is progressively further moved into the hole to enlarge the small diameter hole 26' from top to bottom. It has been observed that the burner b has a natural tendency to follow the vein while being progressively lowered into the hole, thereby preventing the dilution of the high grade materials.

Once a first small diameter hole has been completely enlarged on all the length thereof from top to bottom, it is sealed and a second adjacent small diameter hole is enlarged as per the same procedure, the sealing of the first hole preventing heat from escaping via the first hole when the pillar between the first and second holes spall into fragments under the action of the burner. The fragmented material is typically recuperated as by aspiration through the tube.

According to a further general aspect of the present invention, thermal fragmentation is used to carry out a channeling operation directly into the ore vein deposit to proceed with the extraction of the ore body from the surrounding waste rock without having to drill pilot holes into the vein.

Figure 4:
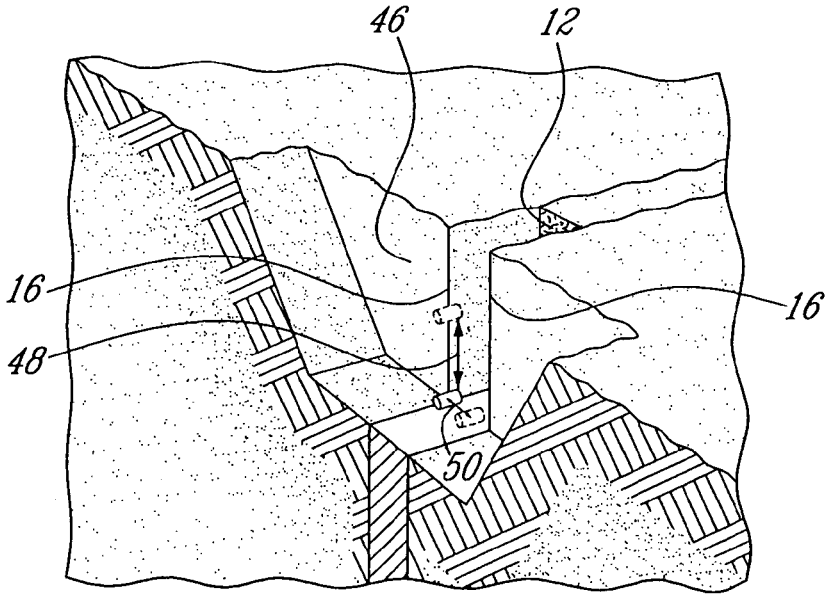
FIG. 4 is a schematic perspective view of a narrow vein in the process of being grooved out by thermal fragmentation in accordance with a further embodiment of the present invention.

As shown in FIG. 4, the ore vein 12 is first localized and a vertical face 46 at one end of the vein 12 is exposed as by excavation. Then, a vertical channel is cut in the exposed vertical face 46 between the rock walls 16 bordering the ore vein deposit. The vertical channel is obtained by directing the flame generated by the diesel burner or another rock spalling tool against the exposed vertical face and by moving the burner vertically and sideways at a controlled rate of travel between the sidewalls 16 of the vein 12 to cause the ore comprised in the vein 12 to spall into fragments. The motion of the diesel burner is confined within the boundaries of the vein, as indicated by arrows 48 and 50. The groove is gradually deepened by continuously re-adjusting the distance between the burner and the bottom of the groove. This distance is herein referred to as the "stand-off distance" and is substantially maintained constant through out the process. To do so, the burner could be mounted on a telescopic mast or boom. Once the telescopic mast has been deployed to its fully extended position, the fragmented material is retrieved as by aspiration, the burner is withdrawn from the groove and the vertical face 46 is blasted to expose a new vertical rock face from where it will be possible to continue the channeling operation of the vein 12. These steps are repeated until the ore vein 12 has been completely extracted.

Figure 5:
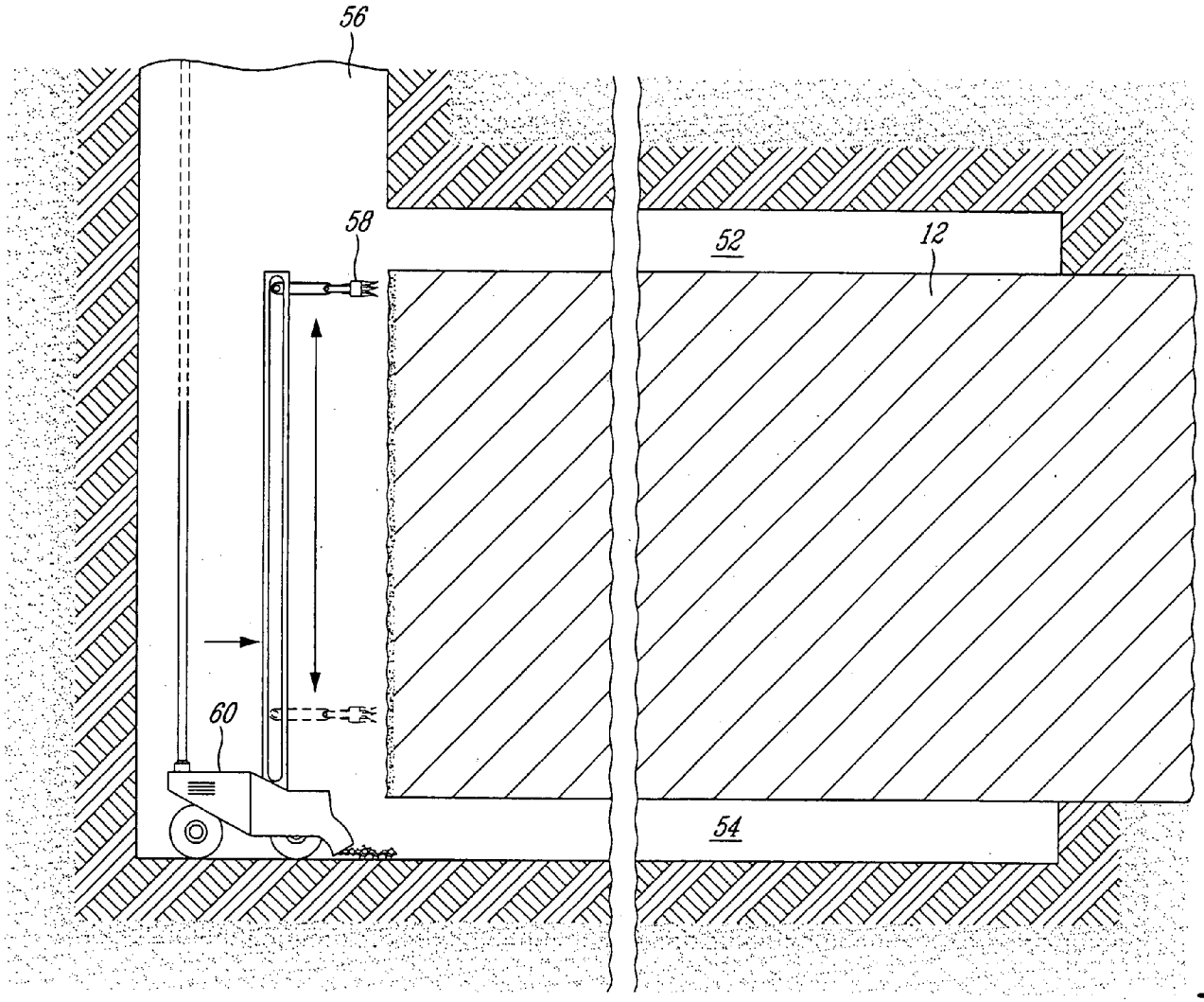
FIG. 5 is a schematic side elevation view illustrating a thermal fragmentation channeling operation carried out for extracting ore from a narrow vein.

FIG. 5 illustrates the adaptation of the above-described spallation channeling technique to an underground vein deposit. As for conventional underground mining operations, the ore vein 12 is sandwiched between top and bottom galleries 52 and 54. Access to the galleries 52 and 54 is provided by a vertical hole 56. The burner 58 is preferably mounted on a robot 60 lowered into the vertical hole 56. The robot 60 is adapted to vertically displace the burner 58 between the top and bottom galleries 52 and 54 and sideways between the sidewalls of the vein 12. The heat generated by the burner 58 causes the ore body forming the vein 12 to spall into chips. As the groove is being formed in the work face, the robot 58 advances further into the groove so as to maintain the burner 58 at a substantially constant stand-off distance from the bottom of the vertical groove. Aspiration is conducted to retrieve the chips from the groove. Once the groove has been deepen by a predetermined distance, a second vertical hole (not shown) is defined and the channeling process is repeated from this new hole. By so repeating the above-described steps, the ore vein can be completely extracted, while avoiding undesired stripping of the surrounding waste rock. In this way, only the true value is extracted.

In summary, numerous advantages can be anticipated when looking at the present ore vein extracting process. In conventional selective mining, a portion of waste rock has to be included in the mineable reserves to allow sufficient space for equipment and workers. As illustrated in FIG. 1, by using the thermal fragmentation mining concept, the portion of waste rock to be excavated is minimal. Therefore, significant savings related to ore handling, ore treatment and environmental control can be realized.

The invention claimed is:

1. A process for extracting ore from a vein having opposed sidewalls, comprising the steps of a) drilling a hole in the vein, b) enlarging an entry end portion of the hole to dimensions suitable for accommodating a burner, c) lowering the burner into the entry end portion of the hole, d) substantially sealing the burner into the entry end of the hole, e) igniting the burner and gradually advancing the burner further into the hole to cause the ore to spall into fragments, and f) recuperating the fragmented ore.

2. A process as defined in claim 1, further comprising the step of connecting a tube to the entry end of the hale, and wherein the burner is lowered into the hole through said tube.

3. A process as defined in claim 2, wherein step f) is effected by aspirating the fragmented ore through said tube.

4. A process as defined in claim 1, wherein the burner is lowered into the hole at a linear speed corresponding to a spalling rate of the ore.

* * * * *